137-13 SR
11/28/78 OR 4,127,140

United States Patent [19]
Sweeney

[11] 4,127,140
[45] Nov. 28, 1978

[54] CRUDE OIL COMPOSITIONS HAVING LOW POUR POINTS

[75] Inventor: William M. Sweeney, Wappingers Falls, N.Y.

[73] Assignee: Texaco Inc., New York, N.Y.

[21] Appl. No.: 854,304

[22] Filed: Nov. 23, 1977

[51] Int. Cl.[2] ..... F17D 1/16; F17D 1/17
[52] U.S. Cl. ..... 137/13; 44/62; 44/70
[58] Field of Search ..... 44/62, 70; 526/331; 137/13

[56] References Cited

U.S. PATENT DOCUMENTS

| | | | |
|---|---|---|---|
| 3,776,247 | 12/1973 | Choufoer et al. | 137/13 |
| 3,830,761 | 8/1974 | Lenney | 526/331 |
| 3,904,579 | 9/1975 | Braddicks | 526/331 |
| 3,915,668 | 10/1975 | Basalay et al. | 44/62 |
| 4,050,742 | 9/1977 | Hughes et al. | 137/13 |

*Primary Examiner*—Winston A Douglas
*Assistant Examiner*—Y. Harris-Smith
*Attorney, Agent, or Firm*—Carl G. Ries; Thomas H. Whaley; Walter D. Hunter

[57] ABSTRACT

A crude oil composition having a low pour point is prepared by incorporating into a waxy crude oil an effective pour depressant amount of an oil-soluble terpolymer, such as vinyl acetate-ethylene-vinyl chloride or allyl chloride terpolymer. The terpolymer may be added with mixing directly to the heated crude or in hydrocarbon solution such as a solution of the terpolymer in a middle distillate or kerosene. In another aspect, this invention relates to a process for the pipeline transportation of the crude oil compositions previously described.

10 Claims, No Drawings

CRUDE OIL COMPOSITIONS HAVING LOW POUR POINTS

BACKGROUND OF THE INVENTION

1. Field of the Invention

This invention is concerned with means for providing crude oil compositions having low pour points containing a waxy crude and an effective pour depressant amount of an oil-soluble terpolymer.

2. Description of the Prior Art

Certain waxy crude oils, such as the high-pour crude oils, exhibit poor flow properties. A number of processes have been suggested in the art for dealing with such flow problems. For example, the pour point of waxy crudes has been improved by the removal of a part of the wax by solvent extraction at low temperatures, with the attendant expense of recovering the solvent, and the problem of disposing of the wax and of providing the cooling requirements which are substantial. In more recently proposed processes, wax has been removed without the use of a solvent by centrifuging a previously heated crude which has been cooled at a critically controlled and slow rate to a centrifuging temperature of around 35°-55° F.

Another widely practiced process involves cutting the waxy high-pour crudes with lighter fractions of hydrocarbons. This process suffers from a number of disadvantages, such as the fact that the procedure involves the use of relatively large amounts of expensive hydrocarbon solvents to transport a relatively cheap product. Furthermore, this practice also necessarily requires that the cutting hydrocarbon solvents be available in suitable quantities which in some instances is inconvenient, and also that there be a ready market for the solvents at the other end of the pipeline.

In transporting waxy crudes with high pour points by one method, heating equipment along the pipeline at frequent intervals is utilized to heat the crude and thus reduce its viscosity. Heaters employed for this purpose can be operated by withdrawing from the crudes being transported for use as fuels. As much as 5 percent of the crude may be utilized in providing the heating necessary for reducing the crude oil viscosity to a suitable value. Furthermore, most pipelines are not equipped with such heating installations. Also, there is the additional problem of contamination of the atmosphere when burning crude oils since they may be difficult to burn completely.

A principal object of this invention is to provide a crude oil composition which possesses an improved pour point and flow properties.

BRIEF DESCRIPTION OF THE INVENTION

In its broadest aspect this invention relates to crude oil compositions having low pour points comprising a waxy crude oil containing an effective pour depressant amount of an oil-soluble terpolymer. The terpolymer used in preparing the crude oil compositions of this invention is a vinyl acetate-ethylene-vinyl chloride or allyl chloride terpolymer. In another aspect this invention relates to a process for the pipeline transportation of the above-described crude oil compositions.

DETAILED DESCRIPTION OF THE INVENTION

Although the crude oil compositions of this invention may be prepared using any crude oil, the terpolymer pour depressant previously described is particularly effective with high pour, waxy crude oils.

Waxy crude oil useful in preparing the novel crude oil compositions of this invention include, for example, the high-pour, high-wax, low-sulfur crude oils having an API gravity of about 30 to about 40; a sulfur content of between about 0.10 and about 2.0 percent by weight; a Saybolt viscosity at 100° F. of about 20 to about 100 SUS; a wax content of between about 3 and 20 percent by weight; and a pour point between about 40° and about 120° F. A waxy, high-pour, low-sulfur crude oil which has been given particularly good results in the low-pour point oil compositions of this invention is known as "Amna" crude and has an API gravity of about 36.0; a Saybolt viscosity of about 69.8 SUS at 100° F.; a pour point of about +70° F.; a wax content of about 14.0 weight percent; and a sulfur content of about 0.15 weight percent. Mixtures of the high-pour, low-sulfur, waxy crude oils may be utilized in preparing the crude oil compositions of this invention, if desired.

The oil-soluble terpolymers useful in preparing the crude oil compositions of this invention comprise recurring units of:

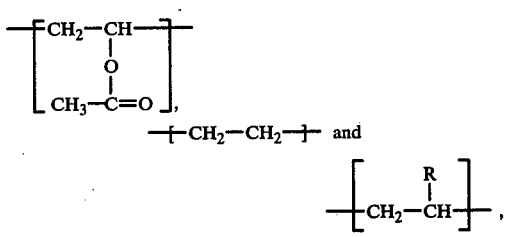

(a) (b) (c)

wherein R is selected from the group consisting of $-CH_2Cl$ and $-Cl$.

The number average molecular weight of the terpolymer utilized in this invention as previously described will range from about 4000 to about 70,000 or more and preferably will be from about 15,000 to about 30,000 as determined by vapor pressure osmometry.

In the vinyl acetate-ethylene-vinyl chloride or allyl chloride terpolymer the weight percent of the a units (i.e., vinyl acetate units) is about 15 to about 40; the weight percent of c units (i.e., vinyl chloride or allyl chloride units) is about 0.5 to about 5.0 with the b units (i.e., ethylene units) being the balance.

Preparation of the vinyl acetate-ethylene-vinyl chloride or allyl chloride terpolymer is conducted using processes well known in the art. For example, ethylene, vinyl acetate, vinyl chloride and benzene are fed continuously into a stirred reactor at a temperature of from about 70° to about 120° C. and under pressures ranging from about 1000 to 5000 psig. A variety of catalysts may be utilized however, a preferred catalyst is azobisisobutyronitrile which is added as a benzene solution at the rate of about 0.5 to 2.0 lbs./1000 lbs. of polymer. Residence time in the reactor is about 0.1 to about 1.0 hours or more. After the reaction mixture is removed from the reactor, the solvent and unreacted starting matter is stripped off yielding the terpolymer product.

The amount of the terpolymer pour depressant incorporated into the crude oil compositions of this invention may be varied over a wide range. Generally the amount of the terpolymer in the crude oil composition will vary from about 0.01 to about 0.50 weight percent and preferably between about 0.02 to about 0.25 weight percent.

The required amount of vinyl acetate-ethylene-vinyl chloride or allyl chloride terpolymer may be added with mixing directly to the residual fuel which preferably is heated. Preferably, the terpolymer is added to the crude oil in solution form dissolved in a hydrocarbon such as benzene, toluene, xylene, kerosene, etc., at a temperature of about 20 to about 120° C. with mixing. Generally, the concentration of the terpolymer in the hydrocarbon will range from about 0.5 to about 10 or more weight percent.

The following example illustrates one embodiment of this invention and is to be considered not limitative.

EXAMPLE I

Ethylene, vinyl acetate, vinyl chloride and benzene are fed continuously at rates of 10.01, 4.49, 0.01 and 2.70 lbs./hrs. respectively into a two liter stirred reactor maintained at a temperature of 80°–110° C. at 4000 psig. Azobisisobutyronitrile is employed as the catalyst and is introduced into the reactor in a benzene solution at the rate of 0.8 lbs./1000 lb. of polymer. The residence time in the reactor is 15 minutes. After the reaction mixture is removed from the reactor it is stripped of solvent and unreacted materials yielding the terpolymer product. The composition of the terpolymer is about 28 weight percent vinyl acetate, 0.7 weight percent of vinyl chloride and 71.3 weight percent ethylene with a number average molecular weight of about 20,000.

A crude oil composition is prepared by adding with mixing at 50° C. for one hour a sufficient amount of the above prepared terpolymer to Amna crude so that the concentration of the additive is 0.10 weight percent. The pour point of this composition is determined by the method of ASTM D-97 and found to be substantially below that of the Amna crude alone which exhibits a pour point of 80° F.

In another aspect, this invention relates to an improved process for the transportation of the novel crude oil compositions described in detail above.

The improved process of this invention for the pipeline transportation of the crude oil composition described above comprises introducing into the said pipeline a crude oil composition comprising a waxy, crude oil and an effective pour depressant amount of the vinyl acetate-ethylene-vinyl chloride or allyl chloride terpolymer. Generally, the amount of the terpolymer will range from about 0.01 to about 0.50 weight percent.

What is claimed is:

1. A crude oil composition having improved pour point characteristics comprising a waxy crude oil and an effective pour depressant amount of an oil-soluble terpolymer comprising recurring units of:

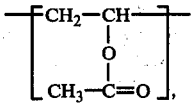

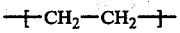

and

-continued

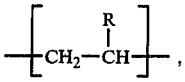

wherein R is selected from the group consisting of $-CH_2Cl$ and $-Cl$.

2. The composition of claim 1 wherein the said terpolymer comprises about 15 to about 40 weight percent vinyl acetate, from about 0.5 to about 5 weight percent vinyl chloride with the balance being ethylene.

3. The composition of claim 1 wherein the said terpolymer comprises about 28 percent by weight vinyl acetate, about 0.7 percent by weight of vinyl chloride with the balance being ethylene.

4. The composition of claim 1 wherein the number average molecular weight of the said terpolymer will range from about 4000 to about 70,000.

5. The composition of claim 1 wherein the number average molecular weight of the said terpolymer will range from about 15,000 to about 30,000.

6. A solution of an oil-soluble terpolymer comprising recurring units of:

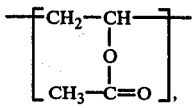

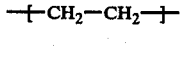

and

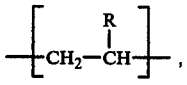

wherein R is selected from the group consisting of $-CH_2Cl$ and $-Cl$, in a hydrocarbon selected from the group consisting of benzene, toluene and xylene.

7. The solution of claim 6 wherein the concentration of the said terpolymer ranges from about 0.5 to about 10 weight percent.

8. In the transportation of crude oils, the improvement which comprises introducing into a pipeline the a crude oil composition comprising a waxy crude oil and an effective pour depressant amount of an oil-soluble terpolymer comprising recurring units of:

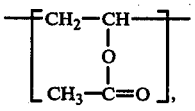

and

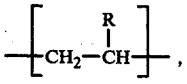

wherein R is selected from the group consisting of $-CH_2Cl$ and $-Cl$.

9. The process of claim 8 wherein the said terpolymer comprises about 15 to about 40 weight percent vinyl acetate, from about 0.5 to about 5.0 weight percent vinyl chloride with the balance being ethylene.

10. The process of claim 8 wherein the said terpolymer comprises about 28 percent by weight vinyl acetate, about 0.7 percent by weight of vinyl chloride with the balance being ethylene.

* * * * *